US012680049B2

(12) United States Patent
Nakajima et al.

(10) Patent No.: US 12,680,049 B2
(45) Date of Patent: Jul. 14, 2026

(54) SLIDING MEMBER

(71) Applicant: SUMITOMO ELECTRIC INDUSTRIES, LTD., Osaka (JP)

(72) Inventors: Shinnosuke Nakajima, Osaka (JP); Makoto Nakabayashi, Osaka (JP); Satoshi Maeda, Osaka (JP); Yugo Kubo, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/873,031

(22) PCT Filed: Jun. 16, 2023

(86) PCT No.: PCT/JP2023/022503
§ 371 (c)(1),
(2) Date: Dec. 9, 2024

(87) PCT Pub. No.: WO2023/248962
PCT Pub. Date: Dec. 28, 2023

(65) Prior Publication Data

US 2025/0361458 A1 Nov. 27, 2025

(30) Foreign Application Priority Data

Jun. 23, 2022 (JP) ..... 2022-101433

(51) Int. Cl.
*C10M 169/04* (2006.01)
*C10M 103/06* (2006.01)
(Continued)

(52) U.S. Cl.
CPC ..... *C10M 169/042* (2013.01); *C10M 103/06* (2013.01); *C10M 107/38* (2013.01);
(Continued)

(58) Field of Classification Search
CPC ..... C10M 169/042; C10M 103/06; C10M 107/38; C10M 107/44; C10M 111/04;
(Continued)

(56) References Cited

U.S. PATENT DOCUMENTS 5,064,298 A * 11/1991 Hibi ..... F16C 33/103 384/450
2012/0101011 A1* 4/2012 Makino ..... C10M 125/00 508/100
(Continued)

FOREIGN PATENT DOCUMENTS

JP 2011-208802 A 10/2011
JP 2017-067048 A 4/2017
(Continued)

*Primary Examiner* — Cephia D Toomer
(74) *Attorney, Agent, or Firm* — Renner, Otto, Boisselle & Sklar, LLP

(57) ABSTRACT

A sliding member according to the present disclosure contains, in a sliding layer, a synthetic resin, a solid lubricant, and an additive. The synthetic resin is a polyimide, a polyamide imide, a polybenzimidazole, a polyphenyl sulfone, a polyether sulfone, a polyether ether ketone, or a combination thereof. The solid lubricant is a polytetrafluoroethylene, a tetrafluoroethylene-perfluoroalkoxyethylene copolymer, molybdenum disulfide, a tetrafluoroethylene-hexafluoropropylene copolymer, or a combination thereof. The contained amount of the solid lubricant in the sliding layer is 5.0-40.0 vol. %. The additive is bentonite, smectite clay mineral, silica, a polyamide, or a combination thereof. The contained amount of the additive in the sliding layer is 0.1-9.0 vol. %.

3 Claims, 1 Drawing Sheet

(51) Int. Cl.

| | |
|---|---|
| ***C10M 107/38*** | (2006.01) |
| ***C10M 107/44*** | (2006.01) |
| ***C10M 111/04*** | (2006.01) |
| ***C10M 125/26*** | (2006.01) |
| ***C10M 149/14*** | (2006.01) |
| ***C10M 149/18*** | (2006.01) |
| ***C10M 159/12*** | (2006.01) |
| *C10N 50/08* | (2006.01) |

(52) U.S. Cl.
CPC ..... *C10M 107/44* (2013.01); *C10M 111/04* (2013.01); *C10M 125/26* (2013.01); *C10M 149/14* (2013.01); *C10M 149/18* (2013.01); *C10M 159/12* (2013.01); *C10M 169/04* (2013.01); *C10M 169/041* (2013.01); *C10M 2201/062* (2013.01); *C10M 2201/0663* (2013.01); *C10M 2201/14* (2013.01); *C10M 2213/0626* (2013.01); *C10M 2217/041* (2013.01); *C10M 2217/0415* (2013.01); *C10M 2217/06* (2013.01); *C10N 2050/08* (2013.01)

(58) Field of Classification Search
CPC ..... C10M 125/26; C10M 149/14; C10M 149/18; C10M 159/12; C10M 169/04; C10M 169/041; C10M 2201/062; C10M 2201/0663; C10M 2201/14; C10M 2213/0626; C10M 2217/041; C10M 2217/0415; C10M 2217/06; C10M 2201/041; C10M 2201/066; C10M 2201/103; C10M 2213/062; C10M 2217/044; C10M 2217/0443; C10M 125/22; C10M 125/30; C10M 147/00; C10N 2050/08; C08J 5/128; C08K 3/34; C08L 27/12; C08L 71/00; C08L 81/00; C09D 5/00; F16C 33/20
See application file for complete search history.

(56) References Cited

U.S. PATENT DOCUMENTS

| | | | |
|---|---|---|---|
| 2018/0230980 | A1 | 8/2018 | Niimi et al. |
| 2020/0408258 | A1* | 12/2020 | Nimura ..... C10M 103/02 |
| 2021/0301872 | A1 | 9/2021 | Inami et al. |

FOREIGN PATENT DOCUMENTS

| | | | |
|---|---|---|---|
| JP | 2020-164805 | A | 10/2020 |
| JP | 2021-156337 | A | 10/2021 |

* cited by examiner

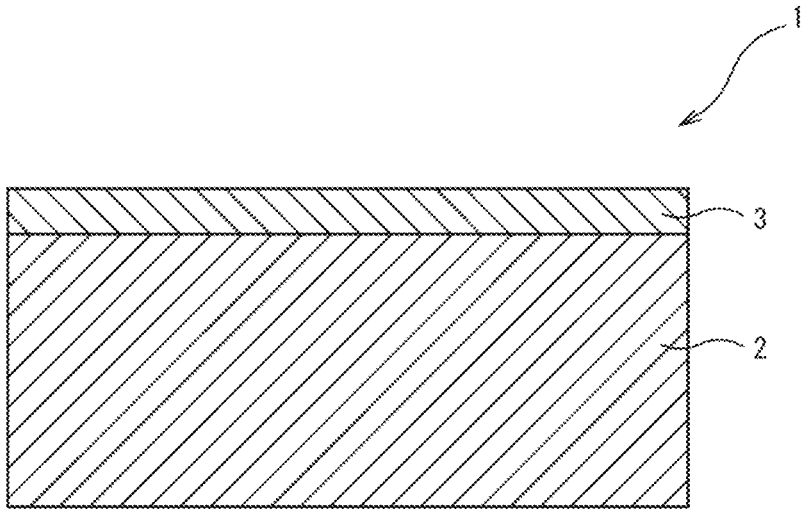
1
3
2

SLIDING MEMBER

TECHNICAL FIELD

The present disclosure relates to a sliding member. This application claims priority based on Japanese Patent Application No. 2022-101433 filed on Jun. 23, 2022, and the entire contents of the Japanese patent application are incorporated herein by reference.

BACKGROUND ART

A sliding member provided in a rotary device or part, such as an oil pump for pumping engine oil to various places in an engine, is required to have wear resistance and heat resistance. As a coating agent for a rotor which is a sliding portion of such an oil pump, a crosslinked fluororesin is disclosed. In the conventional technique, for example, it has been proposed to coat a substrate comprising a sliding member body with a fluororesin irradiated with ionizing radiation (see Patent literature 1).

CITATION LIST

Patent Literature

Patent literature 1: Japanese Unexamined Patent Application Publication No. 2011-208802

SUMMARY OF INVENTION

A sliding member according to an aspect of the present disclosure includes a sliding layer. The sliding layer contains a synthetic resin, a solid lubricant, and an additive. The synthetic resin is polyimide, polyamide-imide, polybenzimidazole, polyphenyl sulfone, polyether sulfone, polyether ether ketone, or a combination thereof. The solid lubricant is polytetrafluoroethylene, a tetrafluoroethylene-perfluoroalkoxyethylene copolymer, molybdenum disulfide, a tetrafluoroethylene-hexafluoropropylene copolymer, or a combination thereof. A content of the solid lubricant in the sliding layer is 5.0 vol % to 40.0 vol %. The additive is bentonite, a smectite clay mineral, silica, polyamide, or a combination thereof, and a content of the additive in the sliding layer is 0.1 vol % to 9.0 vol %.

BRIEF DESCRIPTION OF THE DRAWINGS

FIG. 1 is a schematic cross-sectional view showing a sliding member according to the first embodiment.

DETAILED DESCRIPTION

Problems to be Solved by Present Disclosure

In recent years, in internal combustion engines and the like, with the increasing demand for higher engine speed and improved fuel efficiency, further improvements in sliding characteristics such as wear resistance and abrasion resistance of sliding members have been demanded. Further, since a coating film using a fluororesin coating material as in the conventional technique is relatively soft, a metallic foreign matter such as iron powder is likely to stick into and bite into the surface of the coating film. Thus, there is a problem that the torque of the rotary sliding member is increased due to scratches, breakage, and the like of the coating film.

The present disclosure has been made in view of the above circumstances, and an object of the present disclosure is to provide a sliding member having high hardness, and is excellent in torque reduction effect and wear resistance.

Advantageous Effects of Present Disclosure

A sliding member according to an aspect of the present disclosure has high hardness, and is excellent in torque reduction effect and wear resistance.

Description of Embodiments of Present Disclosure

First, embodiments of the present disclosure will be listed and described.

(1) A sliding member of the present disclosure includes a sliding layer. The sliding layer contains a synthetic resin, a solid lubricant, and an additive. The synthetic resin is polyimide, polyamide-imide, polybenzimidazole, polyphenyl sulfone, polyether sulfone, polyether ether ketone, or a combination thereof. The solid lubricant is polytetrafluoroethylene, a tetrafluoroethylene-perfluoroalkoxyethylene copolymer, molybdenum disulfide, a tetrafluoroethylene-hexafluoropropylene copolymer, or a combination thereof. A content of the solid lubricant in the sliding layer is 5.0 vol % to 40.0 vol %. The additive is bentonite, a smectite clay mineral, silica, polyamide, or a combination thereof, and a content of the additive in the sliding layer is 0.1 vol % to 9.0 vol %.

The sliding member includes a sliding layer, and the sliding layer contains a synthetic resin such as polyimide, polyamide-imide, polybenzimidazole, polyphenyl sulfone, polyether sulfone, polyether ether ketone, or a combination thereof, thereby increasing the hardness of the sliding layer and suppressing the biting of foreign matter. Thus, the sliding layer can be improved in scratch resistance during sliding, and as a result, can be used as a sliding material which can withstand long-term use. In addition, the solid lubricant is polytetrafluoroethylene, a tetrafluoroethylene-perfluoroalkoxyethylene copolymer, molybdenum disulfide, a tetrafluoroethylene-hexafluoropropylene copolymer, or a combination thereof, and the content of the solid lubricant in the sliding layer is set to the above range, thereby improving the wear resistance of the sliding member. Further, the additive is bentonite, a smectite clay mineral, silica, polyamide or a combination thereof, and the content of the additive in the sliding layer is set to the above range, whereby a thixotropic property is imparted to the resin composition constituting the sliding layer. As a result, the surface properties of the sliding layer improve and the wear resistance can be increased. Thus, the sliding member has high hardness, and is excellent in torque reduction effect and wear resistance.

(2) In the above (1), a skewness Ssk of a surface of the sliding layer may be −0.10 or more, and a level difference Sk of a core of the surface of the sliding layer may be 2.5 μm or less. When the skewness Ssk of the surface of the sliding layer is −0.10 or more and the level difference Sk of the core of the surface of the sliding layer is 2.5 μm or less, the torque reduction effect in the sliding member can be further enhanced. The "skewness Ssk" and the "level difference Sk of the core" are parameters of the areal surface texture parameters defined in ISO 25178, and can be measured by a laser microscope. Specifically, the "skewness Ssk" is a parameter of surface roughness defined by ISO 25178 surface properties, and represents the symmetry of the height distribution. The height distribution is vertically symmetrical when Ssk=0, and the surface has many fine peaks when Ssk>0, and the surface has many fine valleys when Ssk<0. The "level difference Sk of the core" is a value obtained by subtracting the minimum height from the maximum height of the core in a load curve representing the ratio of the actual portion and the void portion of the surface unevenness in the height direction.

(3) In the above (1) or (2), the content of the additive in the sliding layer may be 0.5 vol % to 4.0 vol %. When the content of the additive is within the above range, the surface properties of the sliding layer may be further improved, and thus, the wear resistance may be further increased. In addition, in the sliding member, since the hardness of the sliding layer can be further increased, the effect of suppressing the biting of foreign matter can be further improved.

(4) In any one of the above (1) to (3), an average particle size of the solid lubricant may be 0.1 μm to 10.0 μm. When the average particle size of the solid lubricant is within the above range, the surface properties are improved, and the wear amount can be further reduced. In addition, the solid lubricant can be uniformly disposed on the surface of the sliding layer, and the sliding resistance with the mating member is reduced, so that the wear amount of the sliding layer can be reduced.

The "average particle size" means a median size (D50) which is a value at which a volume-based cumulative distribution calculated in accordance with JIS-Z-8819-2: 2001 is 50%. Specifically, the median size (D50) can be a value measured by the following method. The measurement is performed using a laser diffraction particle size distribution analyzer as a measuring apparatus. A scattering type measurement mode is adopted, and a laser beam is projected onto a wet cell in which a dispersion liquid in which particles of a measurement target sample are dispersed in a dispersion solvent is circulated, and a scattered light distribution is obtained from the measurement sample. The scattered light distribution is approximated by a logarithmic normal distribution, and the particle size corresponding to a cumulative degree of 50% (D50) is defined as the median size.

Details of Embodiments of Present Disclosure

Hereinafter, a sliding member according to an embodiment of the present disclosure will be described in detail with reference to the drawings.

<Sliding Member>

A sliding member according to an embodiment of the present disclosure includes a sliding member body and a sliding layer directly laminated on a surface of the sliding member body. FIG. 1 is a schematic cross-sectional view showing a sliding member 1 according to an embodiment of the present disclosure. Sliding member 1 of FIG. 1 is plate-shaped. Sliding member 1 includes a plate-like sliding member body 2 having a surface (an upper surface of sliding member body 2 in FIG. 1) and a back surface (a lower surface of sliding member body 2 in FIG. 1), and a sliding layer 3 directly laminated on the surface of sliding member body 2.

[Sliding Member Body]

The main component of sliding member body 2 is not particularly limited, and examples thereof include metals, super engineering plastics, ceramics, and carbon materials. Examples of the metal include nickel, aluminum, aluminum alloys, copper, copper alloys and iron alloys such as stainless steel. Among these, stainless steel or nickel may be used as the metal because of their excellent malleability and heat resistance. The metals may be used alone or in combination of two or more. Examples of the super engineering plastic include polyimide, polyamide-imide, polyetherimide, polyether ether ketone, polyphenylene sulfide, polyarylate, liquid crystal polymer, polysulfone, and polyether sulfone. Examples of the ceramic include alumina, aluminum nitride, silicon nitride, boron nitride, silicon carbide, zirconia, cordierite, sialon, steatite, sapphire, and cermet. Examples of the carbon material include diamond, graphite, C/C composite, and C/SiC composite. The "main component" refers to a component having the highest content in terms of mass, for example, a component having a content of 60 mass % or more.

The shape of sliding member body 2 is not particularly limited and can be appropriately changed according to the use. For example, the shape of the sliding member is not limited to a plate shape, a cylindrical shape, a conical shape, an elliptic cone shape, a pyramid shape, a gourd shape, an elliptic cylinder shape, and a prism shape, and various shapes of the sliding member such as a rotor can be adopted.

The average thickness of sliding member body 2 is not particularly limited and can be appropriately changed according to the use. Sliding member body 2 may have a through hole.

[Sliding Layer]

In the present embodiment, sliding layer 3 is directly laminated on the surface of sliding member body 2. Sliding layer 3 contains a synthetic resin, a solid lubricant, and an additive. Sliding layer 3 contains the synthetic resin, the solid lubricant, and the additive, and thus has excellent wear resistance.

Sliding layer 3 does not need to be laminated on the entire surface of sliding member body 2, and may be laminated on at least the sliding surface of sliding member body 2. For example, when sliding member body 2 is in a plate shape as shown in FIG. 1, sliding layer 3 may be directly laminated on only a part of the surface of sliding member body 2, or may be directly laminated on the surface and the back surface of sliding member body 2. Further, when sliding member body 2 is cylindrical, the sliding layer may be directly laminated on the entire outer peripheral surface of sliding member body 2, or may be directly laminated on only a part of the outer peripheral surface of the sliding member body. The sliding surface of sliding layer 3 is not necessarily flat, and a pattern such as grooves or dimples (depressions) may be formed on the surface.

Sliding layer 3 may be a coating layer or may be constituted of a film. Sliding layer 3 is formed of a coating layer or a film, and thus the surface roughness of sliding layer 3 and the accuracy of the average thickness of sliding layer 3 can be easily controlled.

The lower limit of the average thickness of sliding layer 3 may be 0.1 μm or 5 μm. The upper limit of the average thickness may be 70.0 μm or 50.0 μm. When the average thickness is less than 0.1 μm, the scratch resistance may be decreased when a foreign matter is caught. When the average thickness is more than 70.0 μm, the elasticity of sliding member 1 may be decreased. Here, the "average thickness" refers to an average value of thicknesses measured at randomly selected ten points.

The lower limit of the skewness Ssk of the surface of sliding layer 3 may be −0.10 or 0. When the skewness Ssk is −0.10 or more, the torque reduction effect can be improved. The upper limit of the skewness Ssk is not particularly limited, but may be 5.0 or 2.1, for example.

The upper limit of the level difference Sk of the core may be 2.5 μm, 2.0 μm, or 1.8 μm. When the level difference Sk of the core is 2.5 μm or less, the torque reduction effect can be improved. The lower limit of the level difference Sk of the core is not particularly limited, but may be, for example, 0.1 μm or 0.5 μm.

(Synthetic Resin)

The synthetic resin may be polyimide, polyamide-imide, polybenzimidazole, polyphenyl sulfone, polyether sulfone, polyether ether ketone, or a combination thereof. The synthetic resin is polyimide, polyamide-imide, polybenzimidazole, polyphenyl sulfone, polyether sulfone, polyether ether ketone, or a combination thereof, and thus the hardness of sliding layer 3 can be increased and the biting of foreign matter can be suppressed. Thus, the scratch resistance of sliding layer 3 during sliding can be improved.

The lower limit of the content of the synthetic resin in sliding layer 3 may be 55 mass %, 60 mass %, or 70 mass %. When the content of the synthetic resin is less than 55 mass %, sliding layer 3 may not have sufficient hardness. The upper limit of the content of the synthetic resin in sliding layer 3 may be 95 mass %, 90 mass %, or 85 mass %. When the content of the synthetic resin is more than 95 mass %, the ratio of the solid lubricant is relatively decreased, and thus sufficient wear resistance may not be obtained.

(Solid Lubricant)

Sliding layer 3 contains a solid lubricant. Sliding layer 3 containing the solid lubricant improves the wear resistance of sliding member 1. The solid lubricant may be polytetrafluoroethylene, a tetrafluoroethylene-perfluoroalkoxyethylene copolymer, molybdenum disulfide, a tetrafluoroethylene-hexafluoropropylene copolymer (FEP), or a combination thereof. Among these, polytetrafluoroethylene and a tetrafluoroethylene-perfluoroalkoxyethylene copolymer can exhibit more excellent wear resistance.

The lower limit of the content of the solid lubricant in sliding layer 3 is 5.0 vol %, may be 10 vol %, and may be 15 vol %. When the content of the solid lubricant is less than 5.0 vol %, the surface properties of sliding layer 3 may be deteriorated, and thus the wear resistance may be decreased. The upper limit of the content of the solid lubricant is 40.0 vol %, may be 30 vol %, and may be 25 vol %. When the content of the solid lubricant is more than 40.0 vol %, the hardness and surface properties of sliding layer 3 may be deteriorated, and thus the wear resistance may be decreased.

The lower limit of the average particle size of the solid lubricant may be 0.1 μm or 0.2 μm. When the average particle size of the solid lubricant is 0.1 μm or more, softening of sliding layer 3 can be suppressed, and the effect of suppressing deterioration of wear resistance and biting of foreign matter can be further improved. The upper limit of the average particle size of the solid lubricant may be 10.0 μm or 9.0 μm. When the average particle size of the solid lubricant is 10.0 μm or less, the surface roughness of sliding layer 3 can be further reduced, and the increase in the wear amount and the torque of sliding layer 3 can be suppressed.

(Additive)

Sliding layer 3 contains an additive. Sliding layer 3 contains bentonite, a smectite clay mineral, silica, polyamide or a combination thereof as an additive, and thus, a thixotropic property is imparted to the resin composition constituting the sliding layer. This improves the surface properties of the sliding layer and can increase the wear resistance. The term "smectite clay mineral" is a generic term for swelling clay minerals, and has a laminated structure of a thin-layer crystal. Examples of the smectite clay mineral include montmorillonite, nontronite, saponite, and beidellite. The additive may be at least partially modified in structure, such as organically modified bentonite, organically modified montmorillonite, and urea-modified polyamide. The "organically modified bentonite" is a bentonite reacted with an organic cation, and the organic cation functions as an organifying agent that imparts an organic group to the bentonite.

The lower limit of the content of the additive in sliding layer 3 is 0.1 vol %, may be 0.2 vol %, and may be 0.5 vol %. When the content of the additive is less than 0.1 vol %, the surface properties of sliding layer 3 may be deteriorated, and thus the wear resistance may be decreased. Meanwhile, the upper limit of the content of the additive may be 9.0 vol %, 7.0 vol %, 5.0 vol %, or 4.0 vol %. When the content of the additive is more than 9.0 vol %, the hardness and surface properties of sliding layer 3 may be deteriorated, and thus the wear resistance may be decreased.

Sliding layer 3 can contain other additive components other than the above-mentioned additives, as necessary. Specifically, for example, additives such as an anti-settling agent, a dispersant, a defoaming agent, a coloring pigment, an antioxidant, an ultraviolet absorber, an antistatic agent, a surfactant, a leveling agent, and a rheology control agent can be used.

[Method of Manufacturing Sliding Member]

A method of manufacturing the sliding member according to an embodiment includes a step of directly laminating a sliding layer containing a synthetic resin, a solid lubricant, and an additive on a surface of a sliding member body.

(Laminating Step)

In this step, a sliding layer containing a synthetic resin, a solid lubricant and an additive is directly laminated on the surface of the sliding member body.

Examples of the laminating include a method of applying a coating material to the outer peripheral surface of the sliding member body by dip coating, electrostatic coating, air spray coating, ink jet coating, dispenser coating, electrodeposition coating, screen printing, spin coating, die coating, roll coating, wire bar coating, blade coating, or gravure coating, and a method of thermo compression bonding a film containing a synthetic resin, a solid lubricant, and an additive onto the sliding member body.

Examples of the coating material include a coating material obtained by dispersing or dissolving a resin composition containing a synthetic resin, a solid lubricant, and an additive in a solvent. As the solvent, an amide-based solvent such as N-methylpyrrolidone, 2-pyrrolidone, dimethylacetamide, N, N-dimethylformamide, or N, N-diethylformamide, or a mixed solvent of the amide-based solvent and another solvent such as water, an alcohol, a ketone, an ether, an ester, an amine, or a combination thereof can be used. The resin composition can be prepared by blending predetermined amounts of the synthetic resin, the solid lubricant, and the additive, and uniformly stirring and mixing the components using the solvent as a solvent by using a mechanical force.

The lower limit of the solid content concentration of the coating material may be 5 mass %, 25 mass %, or 40 mass %. The upper limit of the solid content concentration of the coating material may be 60 mass %, 50 mass %, or 45 mass %. By setting the solid content concentration of the coating material in the above range, the coating property can be improved, and as a result, a coating film with few coating defects can be easily and reliably formed.

The lower limit of the viscosity of the coating material may be 100 cP or 180 cP. The upper limit of the viscosity of the coating material may be 100000 cP or 50000 cP. By setting the viscosity of the coating material in the above range, the coating property can be improved, and as a result, a coating film with few coating defects can be easily and reliably formed. The "viscosity" as used herein refers to a value measured in accordance with JIS-K5600-2-2:1999 "Testing methods for paints—Part 2: Characteristics and stability of paints—Section 2: Viscosity".

When the sliding layer formed of a film is used in the laminating step, the lower limit of the heating temperature of the film in the step of thermo compression bonding the film onto the sliding member body may be 20° C. below the melting point of the fluororesin or the melting point. The upper limit of the heating temperature may be 60° C. or 30° C. above the melting point of the fluororesin. When the heating temperature is less than the lower limit, the adhesion between the film and the sliding member body may be insufficient. When the heating temperature exceeds the upper limit, the releasability from the mold used for the compression bonding is deteriorated, and the fluororesin is peeled and transferred to the mold, so that the compression bonded surface may not be smooth.

When the film is bonded to the sliding member body by thermocompression bonding, the upper limit of the pressing force may be 50 MPa or 10 MPa. The lower limit of the pressures may be 10 kPa or 100 kPa. When the pressure is less than the lower limit, the adhesion between the film and the sliding member main body may be insufficient. When the pressure exceeds the upper limit, the sliding member body and the pressing jig may be damaged, and the equipment cost may increase.

When the film is bonded to the sliding member body by thermocompression bonding, the time for heating and pressing can be, for example, 5 minutes to 2 hours. Further, by using a high-frequency welding machine and performing pressure bonding while applying high frequency, the pressing time can be shortened.

After coating the outer peripheral surface of the sliding member body with a coating material or thermo compression bonding a film, the sliding member body is put into a heating furnace and the resin composition is baked. The solvent in the coating material can be evaporated by the baking. The heating temperature at the time of baking the coating film of the resin composition can be set to, for example, 350° C. to 450° C. The heating time for baking the coating film can be set to, for example, 10 minutes to 60 minutes. By setting the heating temperature and the heating time in the above ranges, a film having excellent denseness can be formed while suppressing decomposition of the synthetic resin. Then, the sliding layer is laminated on the surface of the sliding member body by cooling the sliding member body.

As described above, the sliding layer does not need to be laminated on the entire surface of the sliding member body, and may be laminated on at least the sliding surface of the sliding member body.

The synthetic resin may be crosslinked by irradiating the sliding layer with ionizing radiation. In the irradiation with the ionizing radiation, the sliding layer is irradiated with the ionizing radiation in a low oxygen atmosphere at a temperature equal to or higher than the melting point of the synthetic resin. The irradiation with ionizing radiation is preferably performed before the laminating step. By performing the irradiation of the ionizing radiation before the laminating step, the deterioration of the sliding member body due to the irradiation of the ionizing radiation can be reduced.

The lower limit of the heating temperature in the irradiation with the ionizing radiation may be a temperature higher than the melting point of the synthetic resin by 5° C. or a temperature higher than the melting point of the synthetic resin by 10° C. The upper limit of the heating temperature may be a temperature higher than the melting point of the synthetic resin by 50° C. or a temperature higher than the melting point of the synthetic resin by 30° C. The specific heating temperature can be appropriately changed according to the type of the synthetic resin, and the lower limit thereof may be 320° C. or 330° C. The upper limit of the heating temperature may be 480° C. or 350° C. By irradiating the ionizing radiation at the heating temperature, the crosslinking between molecules can be promoted while suppressing the cleavage of the main chain of the synthetic resin. When the heating temperature exceeds the upper limit, the synthetic resin may be decomposed. The term "melting temperature" as used herein refers to a melting peak temperature measured by a differential scanning calorimeter (DSC) in accordance with JIS-K7121:2012 "Testing Methods for Transition Temperatures of Plastics".

The upper limit of the concentration of oxygen in the low-oxygen atmosphere may be 100 ppm, 10 ppm, or 5 ppm. When the oxygen concentration exceeds the upper limit, the synthetic resin may be decomposed by irradiation with ionizing radiation.

Examples of the ionizing radiation include γ-rays, electron beams, X-rays, neutron beams, and high-energy ion beams, and among these, electron beams are preferable. The lower limit of the dose of ionizing radiations may be 10 kGy, 70 kGy, or 200 kGy. The upper limit of the irradiation dose may be 2,000 kGy, 1,200 kGy, or 400 kGy. When the irradiation dose is less than the lower limit, the crosslinking reaction of the synthetic resin may not proceed sufficiently. When the irradiation dose exceeds the upper limit, the main chain of the synthetic resin may be cut. Thus, by setting the irradiation dose to the above range, the crosslinking can be sufficiently advanced while suppressing the cleavage of the main chain of the synthetic resin. The acceleration voltage can be, for example, 50 kV to 10000 kV.

The sliding member has high hardness, and is excellent in torque reduction effect and wear resistance. Thus, the sliding member can be suitably used as a sliding member for a rotor-type compressor such as a vane, a shoe, or a side plate, or a sliding member provided in a rotary device or component such as a rotor for an oil pump.

Other Embodiments

The embodiments disclosed herein are to be considered in all respects as illustrative and not restrictive. The scope of the present invention is not limited to the configurations of the above-described embodiments, but is defined by the scope of claims, and is intended to include all modifications within the meaning and scope equivalent to the scope of claims.

In the above embodiment, the sliding layer is directly laminated on the surface of the sliding member body, but an intermediate layer may be further provided between the sliding member body and the sliding layer. The sliding member further includes an intermediate layer, and thus the hardness of the sliding layer can be further increased. The intermediate layer may be, for example, a resin layer containing the synthetic resin as a main component.

Examples

The present disclosure will be described in more detail below with reference to Examples, but the present disclosure is not limited to the following Examples.

<Sliding Members No. 1 to No. 35>

[No. 1 to No. 34]

A sliding layer containing a synthetic resin, a solid lubricant, and an additive in the amounts shown in Table 1 was directly laminated on a stainless-steel plate having an average-thickness 1 mm as a sliding member body by the following procedure. In the tables, "—" means that the raw material was not blended. First, the solid lubricant and the additive described in Table 1, and "Ftergent 710FL" manufactured by NEOS COMPANY LIMITED, which is a surfactant, were added to the synthetic resin described in Table 1 so that the weight ratio to the solid lubricant was 0.12. The content of the synthetic resin was adjusted so that the total content of the solid lubricant, the additive, and the surfactant was 100 mass %. That is, the contents of the solid lubricant, the additive, and the surfactant were as described above, and the content of the synthetic resin was the remainder of 100 mass %. The mixture was stirred for 3 hours in 1200 rpm with a magnetic stirrer. The test piece was prepared by coating the mixture on the surface of an aluminum jig of @ 12 mm dedicated for the ball-on-disk test in oil using a rheometer with a non-wire bar coater OSP-120-L60 (manufactured by AS ONE Corporation) to a dry film of which thickness was about 10 μm, drying at 100° C. for 10 minutes, and then baking at 360° C. for 15 minutes. Further, for the measurement of the pencil hardness and the ring-on-disk test, both the right and left sides of a 1 mm steel use stainless (SUS) plate of 40 mm×40 mm were fixed with a masking tape of 50 μm. Further, three masking tapes were superposed on the masking tape attached for fixation, and the masking tapes were fixed so that the total height from the surface of the SUS plate was 200 μm. The coating material prepared here was dropped by about 1 g, and applied by "Non-wire bar coater OSP-05-L60" manufactured by AS ONE Corporation so that the dry film of which thickness was about 20 μm, dried at 100° C. for 10 minutes, and then baked under the condition of 360° C. for 15 minutes to prepare a test piece of 40×40 mm. The film thickness in Table 1 is a dry film thickness.

[No. 35]

No. 35 as a comparative example was prepared in the same manner as No. 1 to No. 34 except that the sliding layer was not laminated on the sliding member body.

The materials used are as follows.

(Synthetic Resin)

(1) Polyimide 1 (PI)

"UPIA-AT-1001" manufactured by UBE Corporation

Glass transition temperature 274° C. to 278° C.

(2) Polyimide 2 (PI)

"Pyre-M.L." manufactured by I.S.T Corporation

Glass transition temperature 300° C. or more (3) Polyimide 3 (PI)

"UPIA-ST-1001" manufactured by UBE Corporation

Glass transition temperature 322° C. to 324° C.

(4) Polyamide-Imide (PAI)

"VYLOMAX HR-11NN" manufactured by TOYOBO Co., Ltd. Glass transition temperature 300° C.

(5) Polybenzimidazole (PBI)

"MRS0810H" manufactured by PBI Advanced Materials Co., Ltd. Glass transition temperature 427° C.

(6) Polyimide 1 and Polyamide-Imide (PI/PAI)

A blended product of the above-mentioned "UPIA-AT-1001" manufactured by UBE Corporation and "VYLOMAX HR 11NN" manufactured by TOYOBO Co., Ltd.

(Additive)

(1) Modified Bentonite 1

Organically modified bentonite: "GARAMITE-7305" manufactured by BYK (2) Modified Bentonite 2

Organically modified bentonite: "CLAYTONE-MPZ" manufactured by BYK (3) Modified Montmorillonite "CLAYTONE APA" manufactured by BYK (4) Polyamide The polyamide was prepared by the following procedure. First, metaphenylenediamine 0.60 g was dissolved in a mixed liquid of methylethylketone 6.50 g, water 1.20 g, and dimethylethanolamine 1.00 g to prepare a solution A. Next, the isophthaloylchloride 1.13 g was dissolved in the methylethylketone 3.20 g to prepare a solution B. Then, while stirring the solution A with a magnetic stirrer, the whole amount of the solution B was added, and the mixture was reacted while continuing stirring for 3 minutes. Next, the whole amount of the reacted solution was added to 100 g of pure water to precipitate the synthesized polymer. The precipitated polymer was filtered using filter paper to recover the precipitated polymer. Thereafter, the recovered precipitates were dried at 100° C. for 1 hour to obtain 0.85 g of polyamide.

(5) Urea-Modified Polyamide

"BYK430" manufactured by BYK (6) Silica

"QS-102" manufactured by Tokuyama Corporation (Solid Lubricant)

(1) Polytetrafluoroethylene 1 (PTFE1)

"TF9207Z" manufactured by 3M Japan Limited, average particle size 4.0 μm (2) Polytetrafluoroethylene 2 (PTFE2)

"KTL-500f" manufactured by KITAMURA LIMITED, average particle size 0.3 μm (3) Polytetrafluoroethylene 3 (PTFE3)

"TF9201Z" manufactured by 3M Japan Limited, average particle size 8.0 μm (4) A Tetrafluoroethylene-Perfluoroalkoxyethylene Copolymer 1 (PFA1) "EA-2000 PW10" manufactured by AGC Inc., average particle size 2.0 μm (5) A Tetrafluoroethylene-Perfluoroalkoxyethylene Copolymer 2 (PFA2)

"MJ102" manufactured by Chemours-Mitsui Fluoroproducts Co., Ltd., average particle size 20.0 μm (6) Molybdenum Disulfide ($MoS_2$)

"T powder" manufactured by Daizo Corporation, average particle size 3.5 μm

TABLE 1

| | SLIDING LAYER | | | | | | |
|---|---|---|---|---|---|---|---|
| | | SOLID LUBRICANT | | | | | |
| | | | PARTICLE | | ADDITIVE | | |
| SAMPLE NUMBER | SYNTHETIC RESIN COMPOSITION | COMPOSITION | SIZE [μm] | CONTENT [vol %] | COMPOSITION | CONTENT [vol %] | THICKNESS |
| 1 | POLYIMIDE 1 | PTFE1 | 4.0 | 20 | — | — | 20 |
| 2 | POLYIMIDE 1 | PTFE1 | 4.0 | 20 | MODIFIED BENTONITE 1 | 0.2 | 20 |
| 3 | POLYIMIDE 1 | PTFE1 | 4.0 | 20 | MODIFIED BENTONITE 1 | 0.8 | 20 |
| 4 | POLYIMIDE 1 | PTFE1 | 4.0 | 20 | MODIFIED BENTONITE 1 | 4.0 | 20 |
| 5 | POLYIMIDE 1 | PTFE1 | 4.0 | 20 | MODIFIED BENTONITE 1 | 7.0 | 20 |
| 6 | POLYIMIDE 1 | PTFE1 | 4.0 | 20 | MODIFIED BENTONITE 1 | 11.0 | 20 |
| 7 | POLYIMIDE 1 | PTFE1 | 4.0 | 20 | POLYIMIDE | 6.0 | 20 |
| 8 | POLYIMIDE 1 | PTFE1 | 4.0 | 20 | MODIFIED BENTONITE 2 | 2.0 | 20 |
| 9 | POLYIMIDE 1 | PTFE1 | 4.0 | 20 | MODIFIED MONTMORILLONITE | 2.0 | 20 |
| 10 | POLYIMIDE 1 | PTFE1 | 4.0 | 20 | UREA-MODIFIED POLYAMIDE | 2.0 | 20 |
| 11 | POLYIMIDE 1 | PTFE1 | 4.0 | 20 | SILICA | 2.0 | 20 |
| 12 | POLYIMIDE 1 | PTFE1 | 4.0 | 2 | MODIFIED BENTONITE 1 | 2.0 | 20 |
| 13 | POLYIMIDE 1 | PTFE1 | 4.0 | 5 | MODIFIED BENTONITE 1 | 2.0 | 20 |
| 14 | POLYIMIDE 1 | PTFE1 | 4.0 | 10 | MODIFIED BENTONITE 1 | 2.0 | 20 |
| 15 | POLYIMIDE 1 | PTFE1 | 4.0 | 15 | MODIFIED BENTONITE 1 | 2.0 | 20 |
| 16 | POLYIMIDE 1 | PTFE1 | 4.0 | 20 | MODIFIED BENTONITE 1 | 2.0 | 20 |
| 17 | POLYIMIDE 1 | PTFE1 | 4.0 | 20 | MODIFIED BENTONITE 1 | 2.0 | 20 |
| 18 | POLYIMIDE 1 | PTFE1 | 4.0 | 30 | MODIFIED BENTONITE 1 | 2.0 | 20 |
| 19 | POLYIMIDE 1 | PTFE1 | 4.0 | 40 | MODIFIED BENTONITE 1 | 2.0 | 20 |
| 20 | POLYIMIDE 1 | PTFE1 | 4.0 | 50 | MODIFIED BENTONITE 1 | 2.0 | 20 |
| 21 | POLYIMIDE 1 | PTFE1 | 4.0 | 60 | MODIFIED BENTONITE 1 | 2.0 | 20 |
| 22 | POLYIMIDE 2 | PTFE1 | 4.0 | 20 | MODIFIED BENTONITE 1 | 2.0 | 20 |
| 23 | POLYIMIDE 3 | PTFE1 | 4.0 | 20 | MODIFIED BENTONITE 1 | 2.0 | 20 |
| 24 | POLYAMIDE-IMIDE | PTFE1 | 4.0 | 20 | MODIFIED BENTONITE 1 | 2.0 | 20 |
| 25 | POLYBENZIMIDAZOLE | PTFE1 | 4.0 | 20 | MODIFIED BENTONITE 1 | 2.0 | 20 |
| 26 | POLYIMIDE 1 POLYAMIDE-IMIDE | PTFE1 | 4.0 | 20 | MODIFIED BENTONITE 1 | 2.0 | 20 |
| 27 | POLYIMIDE 1 | PTFE2 | 0.3 | 20 | MODIFIED BENTONITE 1 | 2.0 | 20 |
| 28 | POLYIMIDE 1 | PFA1 | 2.0 | 20 | MODIFIED BENTONITE 1 | 2.0 | 20 |
| 29 | POLYIMIDE 1 | PTFE3 | 8.0 | 20 | MODIFIED BENTONITE 1 | 2.0 | 20 |
| 30 | POLYIMIDE 1 | PFA2 | 20.0 | 20 | MODIFIED BENTONITE 1 | 2.0 | 20 |
| 31 | POLYIMIDE 1 | $MoS_2$ | 3.5 | 20 | MODIFIED BENTONITE 1 | 4.0 | 20 |
| 32 | POLYIMIDE 1 | $MoS_2$ PTFE1 | 3.5 4.0 | 10 10 | MODIFIED BENTONITE 1 | 4.0 | 20 |
| 33 | PTFE1 | — | — | — | — | — | 20 |
| 34 | POLYIMIDE 1 | — | — | — | — | — | 20 |
| 35 | — | — | — | — | — | — | — |

Evaluation

Next, the sliding members No. 1 to No. 35 were evaluated for skewness Ssk, level difference Sk of the core, torque, abrasion loss, pencil hardness, and limit PV value.

[Areal Surface Texture Parameters as Defined by ISO 25178]

(1) Skewness Ssk

The skewness Ssk [/mm$^2$] of the sliding layer surface was measured for the sliding members No. 1 to No. 35 by the following procedure. As a measuring apparatus, a shape analysis laser microscope "VK-X1100" manufactured by KEYENCE CORPORATION was used. As the measurement conditions, the measurement was performed in an area of 283.0971×212.3238 μm at a total magnification of 1200 on a 23-inch monitor screen using a standard ocular lens type CF IC EPI Plan Apo50X, and height data of 2048×1536 points was obtained. Using multi-analysis application software attached to the laser microscope, a correction of the reference surface was performed with reference to a central portion of 200×200 μm in the measurement data. After the correction of the reference surface, skewness Ssk in the central portion of 200×200 μm was calculated.

(2) Level difference Sk of Core

The level difference Sk [μm] of the core of the surface of the sliding layer was measured for the sliding members No. 1 to No. 35 by the following procedure. As a measuring apparatus, a shape analysis laser microscope "VK-X1100" manufactured by KEYENCE CORPORATION was used. As the measurement conditions, the measurement was performed in an area of 283.0971×212.3238 μm at a total magnification of 1200 on a 23-inch monitor screen using a standard ocular lens type CF IC EPI Plan Apo50X, and height data of 2048-1536 points was obtained. Using multi-analysis application software attached to the laser microscope, a correction of the reference surface was performed with reference to a central portion of 200 μm/200 μm in the measurement data. After the correction of the reference surface, the level difference Sk of the core in the central portion of 200 μm×200 μm was calculated.

[Ball-On-Disk Test in Oil]

(1) Torque

The torque [cN·m] was measured for the sliding members No. 1 to No. 35 in the following procedure. As a mating member to be slid with the test piece, a material made of SUJ2 (high-carbon chromium-bearing steel) and having a ball diameter of ϕ1 mm was used. After the temperature was adjusted to 25±2° C., the reaction torque generated in the mating member was measured under the conditions of lubrication with poly-α-olefin (viscosity VG10), a load of 3 N, and a constant sliding speed of 3 mm/sec. The reaction torque is proportional to the coefficient of dynamic friction. For the measurement, a rheometer "MCR302" manufactured by Anton Paar GmbH was used as a testing apparatus. Torque is an indicator of energy efficiency. The case where the torque is 0.65 cN·m or less is acceptable, and the case where the torque is 0.50 cN·m or less is more excellent.

(2) Abrasion Loss

The abrasion loss [μm] was measured for sliding members No. 1 to No. 35 by the following procedure. Using the rheometer, a sliding test was conducted for 120 seconds under the conditions of a load of 3 N and a sliding speed of 3 mm/sec. The circular sliding groove remained in the sliding member after the test, and the difference in height between the bottom of the sliding groove and the non-sliding surface adjacent to the sliding groove (=the depth of the sliding groove) was measured as the abrasion loss. The abrasion loss was measured using a shape analysis laser microscope "VK-X1100" manufactured by KEYENCE CORPORATION, and was converted into a numerical value by the mode of "mean step" of the attached multi-analysis application. The height of each of the sliding surface and the non-sliding surface was calculated in an area of 50 μm×100 μm.

[Pencil Hardness]

The tips of the pencils were cut into a conical shape using an electric sharpener, and then the pencils were polished in a state perpendicular to a waterproof abrasive paper #2000 manufactured by NIHON KENSHI CO., LTD., and polishing was performed so that the flat portion of the tip of the lead was within a range of φ 0.9 mm to 1.1 mm. The test piece was pressed with a polished pencil at an angle of about 450 and moved at a speed of about 100 mm/sec to evaluate whether the sliding layer was scraped off to expose the substrate. In detail, the test was performed in order from 6B, and when the sliding layer was not scraped off or the pencil lead was broken after three times of the evaluation, the pencil hardness was determined to be passed. The evaluation was performed while increasing the pencil hardness until the sliding layer was scraped off and the substrate was exposed. The pencils used were Mitsubishi Pencils uni 6B to 9H. When the passed hardness is 4H or more, the surface is hardly damaged and can be determined to be good, and when the passed hardness is 2H or less, the surface is easily damaged and can be determined to be unacceptable.

[Limit PV Value by Dry Ring-on-Disk Wear Test]

The sliding members No. 1 to No. 35 were measured for the limit PV value [MPa-m/min] of the sliding surface by ring-on-disk wear in the following procedure. After the temperature was adjusted to 25±2° C., the measurement was performed under the condition that the the load was kept constant at 10 MPa and the speed was increased by one step every 3 minutes. In particular, the ring-shaped mating member was made of S45C (carbon steels for machine structural use) and had a ring size (outside diameter/inside diameter) of φ 11.6 mm/φ 7.4 mm. Then, the test piece was rotated at a predetermined speed (rotation speed: V) in a state where a load (surface pressure: P) of 10 MPa was applied to the mating member under a dry lubrication condition, and the coefficient of dynamic friction was measured by a reaction torque generated in the mating member. At this time, the speed was started at 1 m/min in step (1), increased to 5 m/min in step (2), and to 10 m/min in step (3), and thereafter, the speed was increased by 10 m/min every time the speed was increased by one step, and the limit PV value was measured. In the present disclosure, the PV value just before the exposure of the sliding member body was defined as the limit PV value. For the measurement, "EFM-3-1010-S" manufactured by A&D Company, Limited was used as a testing apparatus. The seizure resistance and wear resistance can be evaluated by the limit PV value of the sliding surface.

Table 2 shows the evaluation results of the skewness Ssk, the level difference Sk of the core, the torque, the abrasion loss, the pencil hardness, and the limit PV value of the sliding members of No. 1 to No. 35. Note that "—" in Table 2 indicates that the corresponding evaluation was not performed.

TABLE 2

| | EVALUATION | | | | | |
|---|---|---|---|---|---|---|
| | AREAL SURFACE TEXTURE PARAMETERS AS DEFINED BY ISO 25178 | | BALL-ON TEST IN OIL | | | DRY RING-ON-DISK WEAR TEST |
| SAMPLE NUMBER | SKEWNESS Ssk | LEVEL DIFFERENCE SK OF CORE Sk [μm] | TORQUE [cN · m] | ABRASION LOSS [μm] | PENCIL HARDNESS | LIMIT PV VALUE [Mpa · m/min] |
| 1 | 0.77 | 3.16 | 0.65 | 1.0~2.0 | 5 H | 1800 |
| 2 | 0.36 | 2.26 | 0.48 | 1.0~2.0 | 5 H | 1800 |
| 3 | 0.53 | 1.80 | 0.34 | 1.0~2.0 | 5 H | 1800 |
| 4 | 0.46 | 1.23 | 0.36 | 1.5~2.5 | 5 H | 1800 |
| 5 | 1.43 | 1.35 | 0.49 | 1.5~2.5 | 4 H | 1400 |
| 6 | 0.57 | 1.51 | 0.53 | 3.0~5.0 | 2 H | 700 |
| 7 | 0.61 | 2.42 | 0.48 | 1.0~2.0 | 5 H | 1600 |
| 8 | 0.81 | 0.98 | 0.37 | 1.0~2.0 | 5 H | 1700 |
| 9 | 1.29 | 1.19 | 0.35 | 1.0~2.0 | 5 H | 1800 |
| 10 | 0.47 | 1.64 | 0.35 | 1.0~2.0 | 5 H | 1800 |
| 11 | 0.78 | 1.22 | 0.39 | 1.0~2.0 | 5 H | 1700 |
| 12 | 1.21 | 0.44 | 0.75 | 1.5~2.5 | 6 H | 300 |
| 13 | 1.61 | 0.63 | 0.54 | 1.5~2.5 | 6 H | 800 |
| 14 | 1.68 | 0.84 | 0.47 | 1.0~2.0 | 6 H | 1000 |
| 15 | 1.50 | 0.25 | 0.45 | 1.0~2.0 | 6 H | 1500 |
| 16 | 0.67 | 1.00 | 0.34 | 1.0~2.0 | 5 H | 1800 |
| 17 | −0.80 | 1.90 | 0.52 | 1.0~2.0 | 5 H | 1700 |
| 18 | 1.10 | 1.04 | 0.35 | 1.0~2.0 | 4 H | 1600 |

TABLE 2-continued

| | EVALUATION | | | | | |
|---|---|---|---|---|---|---|
| | AREAL SURFACE TEXTURE PARAMETERS AS DEFINED BY ISO 25178 | | | | | DRY RING-ON-DISK WEAR TEST |
| | | LEVEL | BALL-ON TEST IN OIL | | | |
| SAMPLE NUMBER | SKEWNESS Ssk | DIFFERENCE SK OF CORE Sk [μm] | TORQUE [cN · m] | ABRASION LOSS [μm] | PENCIL HARDNESS | LIMIT PV VALUE [Mpa · m/min] |
| 19 | 0.17 | 1.30 | 0.35 | 1.0~2.0 | 3 H | 1200 |
| 20 | −0.08 | 2.25 | 0.37 | 20 (ABRADED IN 100 SECONDS) | 2 H | 700 |
| 21 | −0.62 | 1.68 | 0.58 | 20 (ABRADED IMMEDIATELY) | 2 H | 500 |
| 22 | 1.13 | 1.25 | 0.34 | 1.0~2.0 | 4 H | 1500 |
| 23 | 0.55 | 1.55 | 0.39 | 1.0~2.0 | 5 H | 1800 |
| 24 | 2.09 | 0.68 | 0.34 | 1.0~2.0 | 5 H | 1600 |
| 25 | 0.53 | 1.56 | 0.31 | 1.0~2.0 | 7 H | 1800 |
| 26 | 1.12 | 1.20 | 0.35 | 1.0~2.0 | 4 H | 1500 |
| 27 | 0.94 | 0.28 | 0.34 | 1.2~1.4 | 4 H | 1200 |
| 28 | 0.95 | 0.51 | 0.36 | 1.0~2.0 | 5 H | 1800 |
| 29 | 0.21 | 0.86 | 0.45 | 1.0~2.0 | 5 H | 1800 |
| 30 | 1.21 | 4.78 | 0.63 | 1.0~2.0 | 5 H | 1500 |
| 31 | 2.17 | 1.30 | 0.62 | 1.0~2.0 | 5 H | 1300 |
| 32 | 1.78 | 1.40 | 0.52 | 1.0~2.0 | 4 H | 1400 |
| 33 | 1.09 | 0.53 | 0.50 | 10.0 | HB | 1200 |
| 34 | −0.79 | 0.12 | 1.05 | 3.0 | 7 H | 100 |
| 35 | — | — | 1.12 | — | — | 10 |

As shown in Table 2, Nos. 2 to 5, Nos. 7 to 11, Nos. 13 to 19, and Nos. 22 to 32, in which the sliding layer contained polyimide, polyamide-imide, or polybenzimidazole as the synthetic resin, contained polytetrafluoroethylene, a tetrafluoroethylene-perfluoroalkoxyethylene copolymer, or molybdenum disulfide as the solid lubricant, contained bentonite, a smectite clay mineral, silica, or polyamide as the additive, and had a solid lubricant content of 5.0 vol % to 40.0 vol % and an additive content of 0.1 vol % to 9.0 vol %, exhibited good results in all of the torque, the abrasion loss, the hardness, and the limit PV value.

No. 1 which did not contain the additive and had Sk of 3.16 had high torque. No. 6 in which the content of the additive is more than 9.0 vol % was evaluated as poor in all of the torque, the abrasion loss, the hardness, and the limit PV value. In No. 12 in which the content of the solid lubricant was less than 5.0 vol %, the torque was increased, and the limit PV value was decreased. Nos. 20 and 21, in which the content of the solid lubricant is more than 40.0 vol %, were evaluated as poor in terms of the abrasion loss, hardness, and limit PV value. No. 33, which contained polytetrafluoroethylene as the synthetic resin and did not contain the solid lubricant and the additive, was inferior in the evaluation of the abrasion loss and the hardness. In No. 34 in which neither solid lubricant nor additive was contained, the torque was high and the limit PV value decreased. In No. 35 having no sliding layer, the torque was increased and the limit PV value was remarkably decreased.

From the above, it was shown that the sliding member had high hardness, and was excellent in torque reduction effect and wear resistance.

REFERENCE SIGNS LIST

1 sliding member
2 sliding member body
3 sliding layer

The invention claimed is:

1. A sliding member comprising a sliding layer,
wherein the sliding layer contains a synthetic resin, a solid lubricant, and an additive,
the synthetic resin is polyimide, polyamide-imide, polybenzimidazole, polyphenyl sulfone, polyether sulfone, polyether ether ketone, or a combination thereof,
the solid lubricant is polytetrafluoroethylene, a tetrafluoroethylene-perfluoroalkoxyethylene copolymer, molybdenum disulfide, a tetrafluoroethylene-hexafluoropropylene copolymer, or a combination thereof,
a content of the solid lubricant in the sliding layer is 5.0 vol % to 40.0 vol %,
the additive is bentonite, a smectite clay mineral, silica, polyamide, or a combination thereof, and
a content of the additive in the sliding layer is 0.1 vol % to 9.0 vol %
wherein a skewness Ssk of a surface of the sliding layer is-0.10 or more, and
a level difference Sk of a core of the surface of the sliding layer is 2.5 μm or less.

2. The sliding member according to claim 1, wherein the content of the additive in the sliding layer is 0.5 vol % to 4.0 vol %.

3. The sliding member according to claim 1, wherein an average particle size of the solid lubricant is 0.1 μm to 10.0 μm.

* * * * *